US006062295A

United States Patent [19]

Greiwe

[11] Patent Number: 6,062,295

[45] Date of Patent: May 16, 2000

[54] DEVICE FOR WITHDRAWING A STRAND

[75] Inventor: Reinhard Greiwe, Estenfeld, Germany

[73] Assignee: Mannesmann Aktiengesellschaft, Düsseldorf, Germany

[21] Appl. No.: 09/065,353

[22] Filed: Apr. 23, 1998

[30] Foreign Application Priority Data

Apr. 24, 1997 [DE] Germany ..... 197 17 914

[51] Int. Cl.[7] ..... B22D 11/128

[52] U.S. Cl. ..... 164/448; 164/442; 72/248

[58] Field of Search ..... 164/441, 442, 164/447, 448; 72/246, 248; 226/186, 187

[56] References Cited

U.S. PATENT DOCUMENTS 3,089,363 5/1963 Wallace et al. ..... 72/248
4,090,549 5/1978 Ives et al. ..... 164/442

FOREIGN PATENT DOCUMENTS 0 545 104 11/1992 European Pat. Off. .
744 299 1/1944 Germany .
57-75239 5/1982 Japan ..... 72/248
64-5651 1/1989 Japan ..... 164/448

OTHER PUBLICATIONS

Mannesmann Demag, "Stranggießanlagen für Bolzen und Walzplatten aus Kupfer", pp. 1–10.

*Primary Examiner*—Kuang Y. Lin
*Attorney, Agent, or Firm*—Cohen, Pontani, Lieberman & Pavane

[57] ABSTRACT

A device for withdrawing a strand, especially a metal strand, from a continuous casting mold, includes drivable rollers that are located on opposite sides of the strand and are rotatably mounted on both sides in chocks. For adjustment to the strand cross-section, the rollers, with their chocks, can be moved toward and away from each other in a housing frame, and can be pressed against the strand surface in a force-operated or pressure-medium-operated fashion. Each chock of the first roller is connected via a tension member to a positioning device run in the guide of a clamping unit. Drives of the positioning unit are connected to chocks of the second roller to move the second roller toward or away from the first roller, the second roller being arranged between the positioning device and the first roller.

14 Claims, 8 Drawing Sheets

DEVICE FOR WITHDRAWING A STRAND

FIELD OF THE INVENTION

The invention relates to a device for withdrawing a strand, especially a metal strand, from a continuous casting mold with two drivable rollers that are positioned for clamping the strand on opposite sides of the strand. Both sides of the two drivable rollers are mounted in chocks. For adjustment to the strand cross-section, the rollers are movably mounted in the chocks, for movement toward and away from each other in a housing frame. The rollers may also be pressed against the strand surface in a force-operated or pressure-medium-operated manner.

BACKGROUND OF THE INVENTION

Devices for withdrawing continuously cast strands from a mold are known in many different forms and designs. Such devices are used to withdraw the strand that has been produced from the mold continuously or discontinuously at a targeted speed. The cast strands themselves have a wide variety of cross-sectional shapes. For grasping a strand in the transport direction, rollers are placed on and pressed against the surface of the strand. In some cases, the rollers surfaces are profiled to better grasp the strand surface or have grooves that match the strand surface. These prior art devices for withdrawing continuously cast strands comprise a clamping unit in which driven rollers are movably mounted in chocks. For adjustment to a particular strand cross-section, the rollers mounted on the chocks are moved toward or away from each other using worm drives or piston-cylinder units. The support forces of the rollers on the strand surface are absorbed by spindles of the worm drive or piston-cylinder units and transmitted to the housing frame. For adjustment to different continuously cast cross-sections, such as, for example, when there is a change in product cross-section, extensive changeover measures are necessary to exchange the rollers mounted in the chocks for other rollers.

The clamping units of the prior art devices are designed to absorb the largest pressure forces that may occur and are therefore frequently oversized. The flexibility of the machine is limited, because the given kinematics permit only limited adjustment. Therefore, when the type of strand being produced is changed, time-consuming changeover adjustments of the clamping units are required.

SUMMARY OF THE INVENTION

The object of the present invention is to provide a device for withdrawing a strand, especially a metal strand, from a continuous casting mold that is markedly simple to operate in that the device is simply adjustable for receiving different continuously cast strand cross-sections, and to provide a device that comprises the greatest possible flexibility in adjustment to a wide variety of different continuously cast strand cross-sections.

To attain this object, it is proposed according to the invention that each chock of the first roller be fixedly positioned via a stiff tension member to a positioning device such as a worm drive, toothed gearing, or a piston-cylinder. The chocks of a second roller are movable and wherein spindles, toothed rods, or piston rods of the positioning device are oriented parallel to the movement direction of the chocks are connected to the two chocks of the second roller, for moving the second roller toward or away from the first roller. The second roller is arranged between the positioning device and the first roller.

Thus, according to the invention, the device for withdrawing a strand comprises a self-contained clamping unit that clamps the continuously cast strand. The configuration of the clamping unit is especially advantageous in that the flow of force for clamping the strand between the rollers passes from the strand, through the first roller via the tension member to the positioning device and, from there runs via the spindle, toothed rod, or piston rod to the second roller. The clamping process of this configuration causes no additional reaction forces to occur on the housing frames of the two rollers, which disadvantageously occurs in the prior art. The two rollers are movable with respect to each other within the compact clamping unit, which in turn is disposed in a housing frame. When the spindles, toothed rods, or piston rods of the positioning device are adjusted, the two rollers move toward or away from each other to the same extent and thus automatically assume a symmetrical position relative to a longitudinal axis of the cast strand.

The tension members comprises of tension strips, which connect the chocks of the first roller to the positioning device in a force-locking and/or positive-locking fashion. Owing to the positive-locking connection, the tension strips are kept free of attachment borings, so that there is no weakening of the parts being connected.

In an optional embodiment of the invention, a load cell is arranged between the spindle, toothed rod, or the piston-cylinder unit and the chock of the second roller. Preferably, the load cell is mounted only on the drive side of the rollers. In this case, an adapter for connecting the spindle, toothed rod, or piston rod to the chock is used on the other side. The load cell measures the clamping pressure, which acts equally on all chocks of the first and second rollers.

According to another optional embodiment of the invention, a disc spring is inserted between the spindle, toothed rod, or piston rod and the second roller to compensate for slight differences in diameter of the continuously cast strand.

According to another embodiment of the invention, each positioning device has its own drive motor. In a preferred embodiment, the positioning devices of the two sides are connected to each other via a connecting shaft and driven by a common drive motor. The connecting shaft is usually run in an offset manner relative to a plane which intersects the rotational axes of the first and second rollers.

According to a further embodiment of the invention, multiple strands are supported by the first and second rollers. In this embodiment, the first and second rollers are mounted in their chocks in spherical roller bearings, to compensate for diameter differences in the multiple strand. This embodiment is preferably used with individual drives for the two positioning devices and the connecting shaft omitted. In the preferred embodiment, the spherical roller bearings compensate for angular deviations of approximately 2° but may be designed to compensate for more or less depending on the requirements of the system in which the invention is installed.

The device for withdrawing a strand from a continuous casting mold may comprises more than one clamping unit and the parts disposed therein which may be mounted on a housing frame. This enables the quick and efficient change of essential components by merely exchanging one clamping unit for another.

Several clamping units of similar design may be placed one atop the other and fixedly held together within a frame. In this embodiment form, one device for withdrawing a strand may be used to handle the complete casting program of a casting machine with a small number of clamping units, preferably of three different lengths. Each clamping unit differs from the others only in adjustment range and required clamping pressure. The structural size of the positioning device and the tensile force of the disc springs must be adjusted for each part of the process to minimize deformation of the strand.

Each clamping unit is located in a housing frame. The frame is designed in modular fashion and comprises supports, carriers and traverses which are fixedly assembled into a rigid frame. The use of a modular frame maximizes the flexibility of the inventive device.

The modular construction permits many different possible combinations, without requiring that the adjustment range of the rollers be limited. It is simple to change the strand spacing in keeping with customer requests, because each clamping unit is designed to be freely movable. The clamping units and rollers make it possible to withdraw both slabs and bolts, or a combination of the two, as desired, so that a simple and universally applicable assembly may be created.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like references characters denote similar elements throughout the several views.

DETAILED DESCRIPTION OF THE PREFERRED EMBODIMENTS

Figure 1:
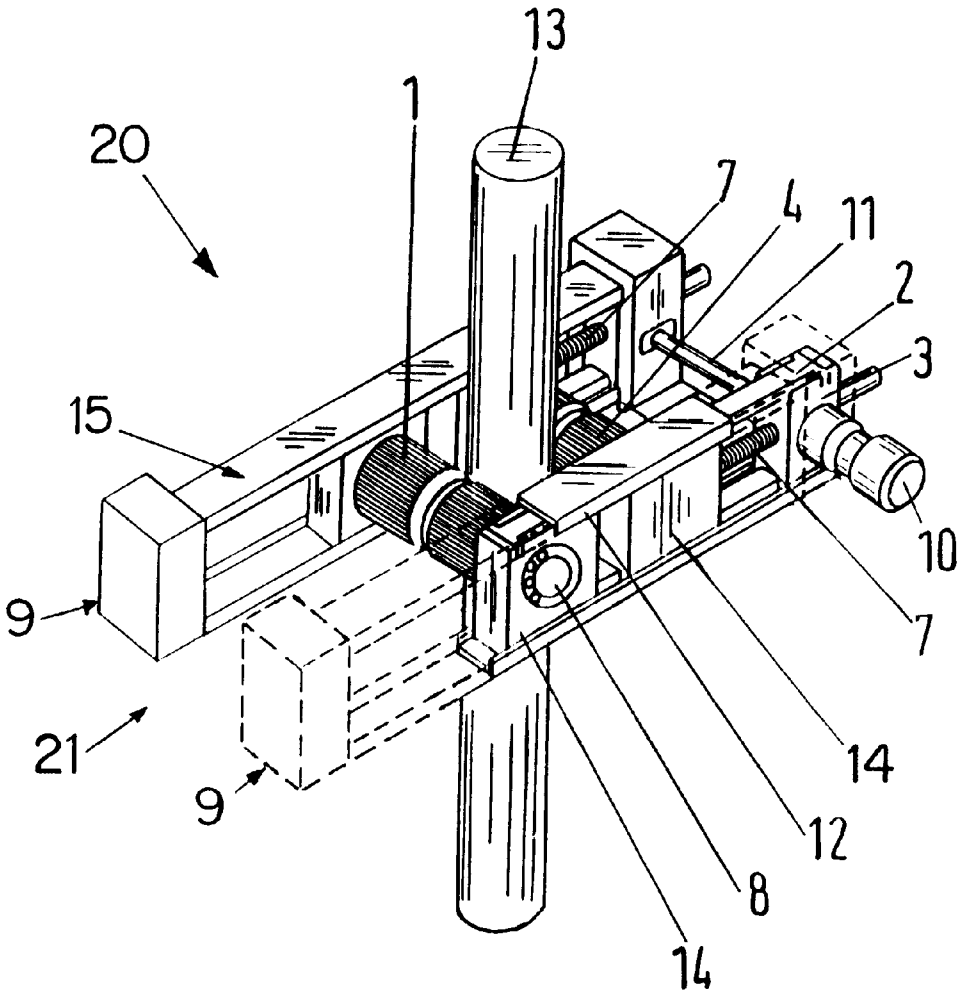
FIG. 1 is a perspective view of an embodiment of a strand withdrawing device according to the invention.
Figure 2:
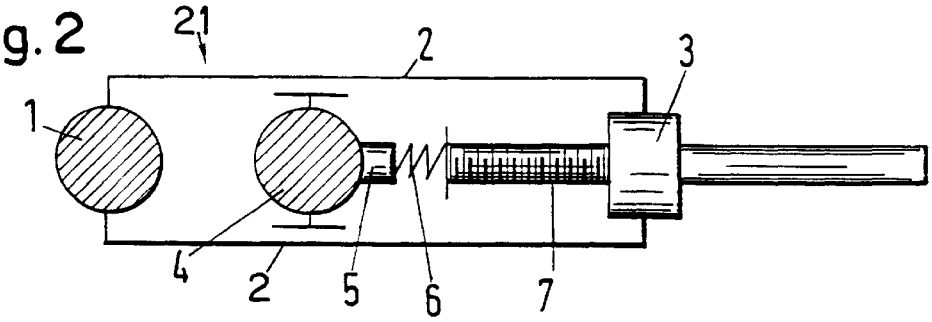
FIG. 2 is a schematic diagram of a short clamping unit of the strand withdrawing device of FIG. 1.
Figure 3:
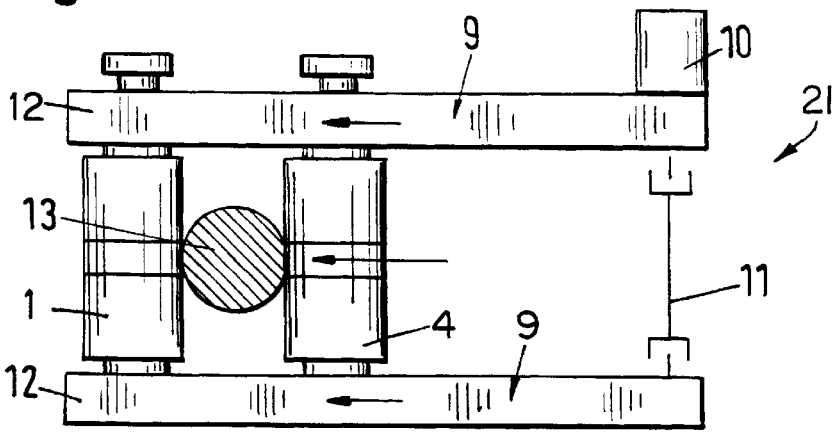
FIG. 3 is a top view of the short clamping unit shown in FIG. 2.

Referring initially to FIGS. 1, 2 and 3, a first embodiment of a device for withdrawing a strand 20 according to the invention is shown with one clamping unit 21. The clamping unit 21 comprises a first roller 1 and a second roller 4 (collectively referred to as rollers 1, 4). The ends of the rollers 1, 4 are rotatably received by bearing 8 in chocks 14. The chocks 14 in turn, are held in two side pieces 9. The first roller 1 is fixedly held in place with respect to the side pieces 9 by tension strips 2. The tension strips 2 also connect the first roller to positioning devices 3 at each side piece 9. The second roller 4 is movably connected to positioning devices 3 on each of the side pieces 9. A drive 7 is connected between each positioning device 3 and a chock 14 of the second roller 4. When activated, the positioning device 3 axially moves the drive 7 so that the second roller 4 is moved toward or away from the first roller 1. In the embodiment shown in FIG. 1, the positioning devices 3 are shown as worm drive lift gears. However, any type of positioning device may be which functions to move the second roller 4 relative to the first roller 1 along the side pieces 9, such as, for example, toothed gearing or a piston-cylinder unit. In an optional embodiment, the positioning devices 3 in each of the two side pieces 9 of the clamping unit 21 are connected mechanically, with respect to drive by a connecting shaft 11 and are adjustable via a common drive 10.

A strand 13 is clamped between the rollers 1, 4 which are held by the side pieces 9. From the strand 13, the flow of the clamping force runs from the first roller 1 through the secure connection of the tension strips 2 at the first roller 1 to the positioning device 3 and back to the second roller 4 via the drive piece 7. A housing frame 15 holds the side pieces 9 of the clamping unit 21. The housing frame 15 is constructed modularly and comprises supports, carriers and traverses that are affixed to each other to form a rigid frame structure. As a result, the device achieves maximum flexibility with high overall stability. Since the clamping force flow is closed, as described above, no clamping forces are transmitted to the housing frame 15 due to the clamping process.

The transmission of the clamping force between the first roller 1 and the positioning device 3 is maintained, due to the high surface pressure of the chocks 14 holding the first roller 1 against the tension strip 2. The chocks 14 holding the first roller 1 are connected to the tension strips 2 in a positive-locking or force-locking fashion. The housing frame 15 comprises a plate 12 that is fixedly connected, such as, for example, with a screw, to each side of the side pieces 9. The plate 12 aids in the guiding of the chocks 14 of the rollers 1, 4 and/or of the positioning device 3 and holds the positive-locking tension strip 2 in the frame 15. As a result, further connecting elements to the tension strip 2 are unnecessary, and the tension strip 2 is not weakened by attachment borings. Alternatively, if the chocks 14 holding the first roller 1 are in a positive-locking connection with the tension strip 2, the plate 12 may be eliminated, and the chock 14 may guide themselves along the tension strip 2. In any embodiment, the second roller 4 has no locking connection to the tension strip 2, but uses the plate 12 and or the tension strip 2 as a guide.

The clamping pressure, which is for example, 500 kN at a maximum in the preferred embodiment, is divided equally between the two side pieces 9. FIG. 2 shows that a load cell 5 may be mounted between drive 7 and second roller 4 on the drive side for measuring clamping pressure. Only one load cell 5 is required and an adapter may be used at the other sides of the chocks 14 since the clamping pressure is evenly distributed at each of the chocks 14.

Disc springs 6 are optionally installed in the drives 7 for permitting a compensation of the position of the second roller 4 in response to a chance in the diameter of strand 13

(FIG. 2). In this embodiment, the clamping force applied to the strand 13 is proportional to the degree of compression of disc spring 6.

In the following examples, the clamping units 21 are divided into three different embodiment or modules, the clamping unit 21 shown in FIGS. 2 and 3 is a short clamping unit 21. The others are a medium clamping unit and a long clamping unit which include progressively greater strand width capacity. The short, medium, and long clamping units mounted in various combination within a frame 50 permit one strand withdrawing device 20 to accommodate all possible types of strand output from a continuous cast mold. The short, medium, and long clamping units differ only in strand width adjustment range and required clamping pressure. The size of the positioning device 3 and the tensile force of the disc spring 6 require adjustment to the given circumstances, to minimize deformation of the strand 13. Although three different sizes of clamping units are disclosed in the preferred embodiment, any number of clamping units may be used to accept all required strand sizes for a particular application.

Figure 4A:
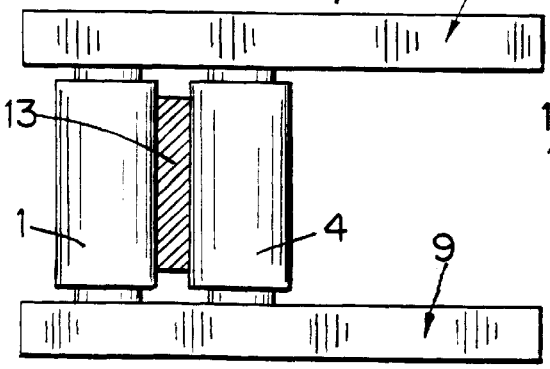
FIG. 4*a* is a top view of an embodiment of a clamping unit of the strand withdrawing device according to the invention.
Figure 4B:
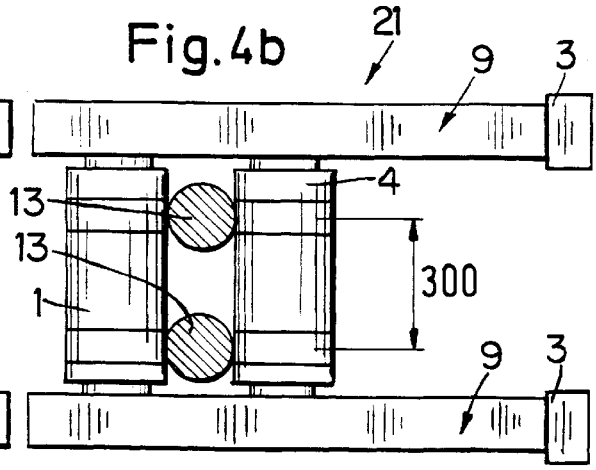
FIG. 4*b* is a top view of the another embodiment of the clamping unit of the strand withdrawing device for strands comprising two bolts.

The short clamping unit 21 depicted in FIGS. 2 and 3 is a pure bolt machine with an adjustment range of 10 mm to 370 mm. The short clamping unit 21 may also be used to clamp a vertically cast strip as shown in FIG. 4*a*. In yet another alternative, the short clamping unit 21 may also be used to simultaneously clamp two bolts, i.e., strands having a circular cross-section, as shown in FIG. 4*b*. Because the bolts may differ slightly in diameter, a slanted position of the rollers 1, 4 is enabled by using spherical roller bearings 8. To allow each strand 13 to be securely clamped in the event of different diameters, each side piece 9 comprises its own positioning device 3. Therefore, the connecting shaft 11 is necessarily omitted (see FIG. 4*b*). The spherical roller bearings 8 compensate for an angular deviation of approximately 2°. Given a strand spacing of 300 mm, this corresponds to a difference in diameter of 10 mm. However, other deviations may be accommodated depending on the requirements of the particular application.

Figure 5A:
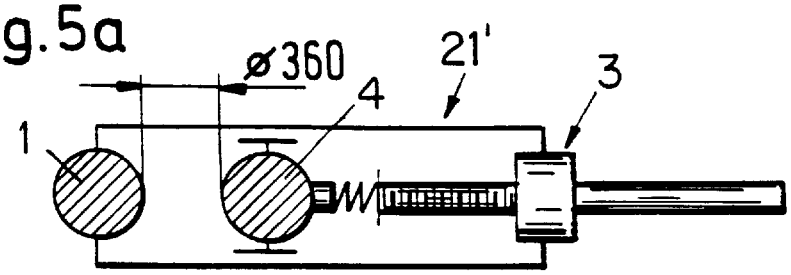
FIGS. 5*a,b* are schematic diagrams of a medium clamping unit of the strand withdrawing device showing two different strand width settings of the device.
Figure 5B:
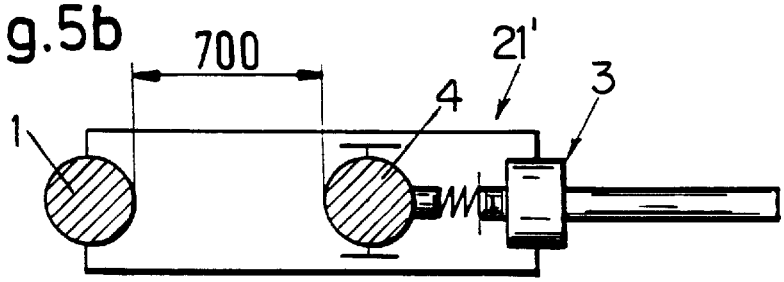
FIG. 5*c* is a top view of the embodiment as in FIG. 5*b* with a strand comprising an ingot sheet.
Figure 5C:
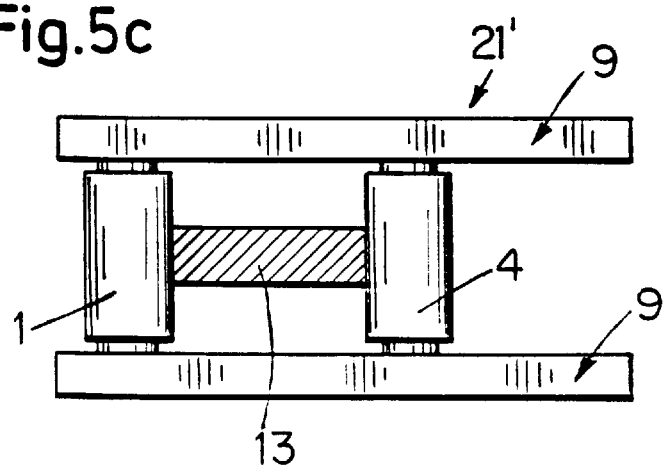

FIGS. 5*a* and 5*b* show a medium clamping unit 21" for strands comprising bolts and sheet ingot with an adjustment range of 10 mm to 760 mm. FIG. 5*c* shows the medium clamping unit 21' with a strand 13 comprising a sheet ingot clamped on the narrow sides. Calculated estimates have shown that the bending is smaller in this configuration, despite the larger axial distance, than that of the float-mounted rollers of the prior art.

Figure 6:
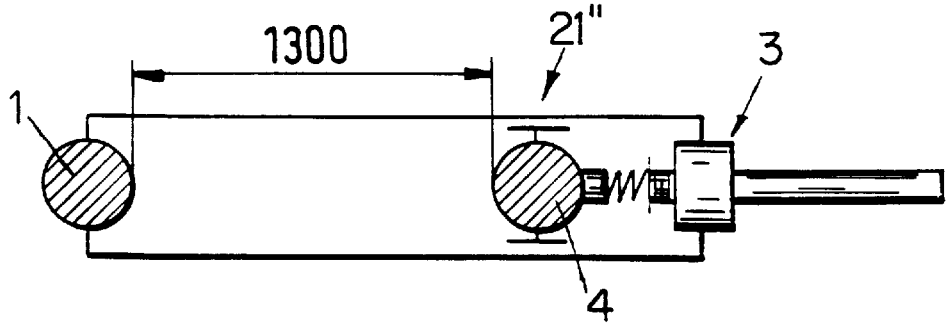
FIG. 6 is a side view of a long clamping unit of the strand withdrawing device with a larger strand width adjustment range.

FIG. 6 shows the long clamping unit 21" with an adjustment range of 10 mm to 1300 mm. Using various combinations the short, medium, and long clamping units 21, 21', and 21" the withdrawal of a large variety of sizes and types of strands 13 are possible, without requiring limitations in the adjustment range. The strand distance can be simply changed at customer request, because each clamping unit can be moved freely within the frame 15 (FIG. 1). In addition, since the frame 15 is modular, it can easily be added to or altered to accommodate a new configuration.

To prepare one of the short, medium, or long clamping units 21, 21', or 21' for operation, the first roller 1 must be axially fixed in the housing frame 15 in accordance with the type of strand 13 to be withdrawn. The connecting shaft 11, which under certain circumstances could interfere with another strand 13 being withdrawn, is positioned below one of the rollers 1, 4 of another clamping unit 21, 21', or 21", and thus does not interfere with the process.

The short, medium, or long clamping unit 21, 21', or 21" is disposed in the housing frame 15. When a change in the type or size of strand being cast is required, for example, from bolts to sheet ingots, the clamping unit 21, 21', 21" is moved axially. So that no additional auxiliary drive is needed, two stop strips are installed in the guides 12 of the housing frame 15 and permit the directed movement of the rollers or their chocks with the available worm drive lift gears 3 (the stops are described in greater detail below).

In a single-strand bolt machine, using commercially available and economical slip-on gears, articulated shafts and distributor gears can be dispensed with. In multi-strand units, the most economical solution is the classic arrangement in which the roller stand is connected via articulated shafts to a stationary distributor gear (this arrangement is also discussed in greater detail below).

Figure 7:
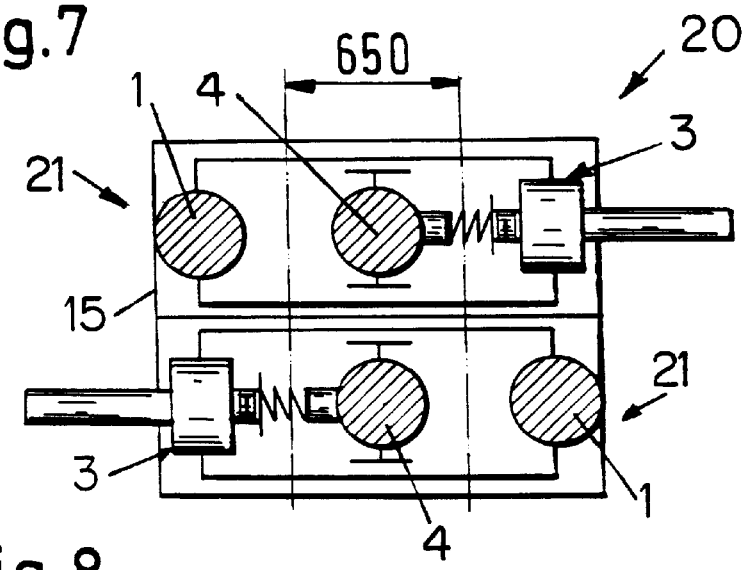
FIGS. 7–17 show various embodiments of the strand withdrawing device according to the invention.

FIGS. 7 to 17 show various embodiments of the device for withdrawing a strand according to the invention. FIG. 7, for example, shows two short clamping units 21 for a strand withdrawal device 20 for withdrawing two strands comprising bolts up to 360 mm in diameter. As the drawing shows, the two short clamping units 21 are arranged one above the other in the housing frame 15. This particular embodiment has a standing width of 1500 mm. The two short clamping units 21 are arranged such that the positioning device 3 of each is directed toward a different side of the strand withdrawing device 20 (left and right in FIG. 7). This configuration enables the simultaneous withdrawal of two strands 13 at a distance of 650 mm, without one of the short clamping units 21 interfering with the other.

Figure 8:
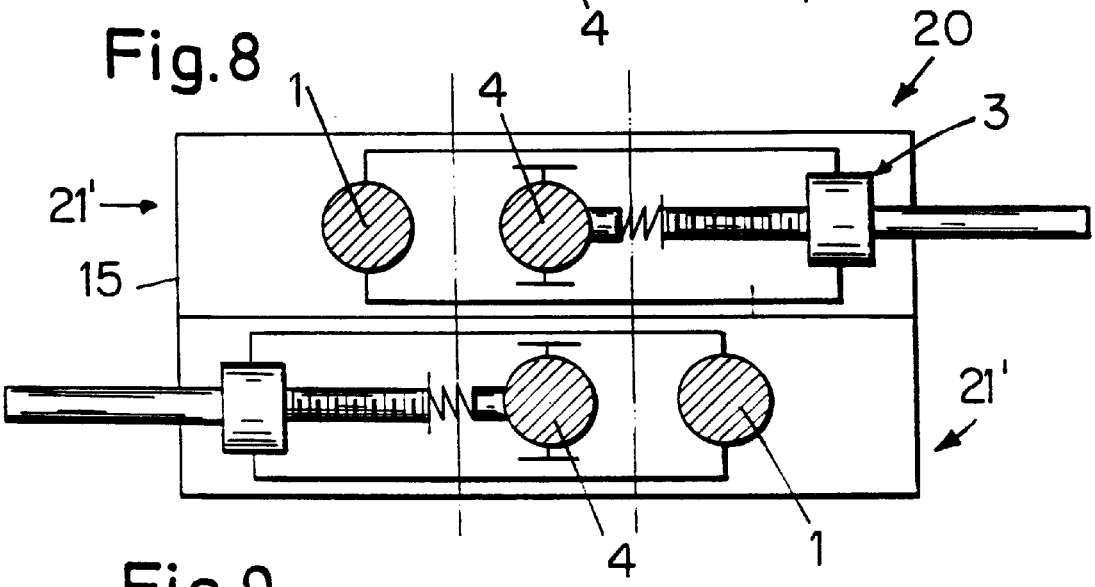

FIG. 8 shows a different embodiment of the same type of strand withdrawal device 20 using two medium clamping units 21'. The standing width of this embodiment is 2500 mm. Here, one or two strands 13 as well a strand comprising sheet ingots may be drawn.

Figure 9:
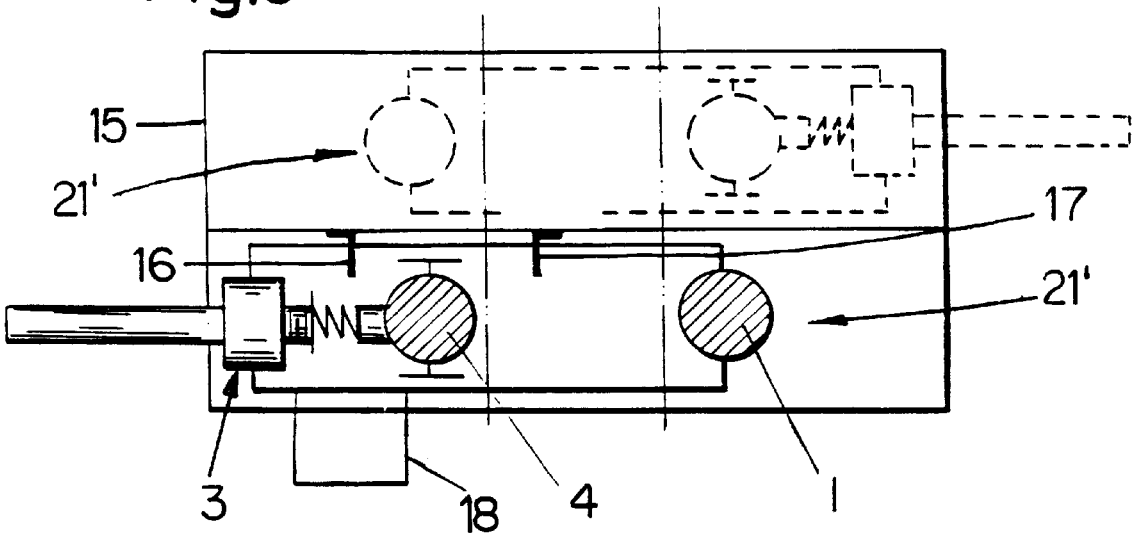

FIG. 9 shows a single-strand device for withdrawing a strand 20 for strands 13 comprising sheet ingots up to 700 mm in width. The frame 15 of this embodiment corresponds to the device in FIG. 8. The upper one of the medium clamping units 21 ' must be moved to a rest position (shown in dashed lines) or removed from the frame to accomplish this result.

Using FIG. 9, the use of stops for moving the position of the first roller 1 will be explained. When the casting program of the cast mold is to be changed, such as, for example, from bolts to sheet ingots, axial movement of the first roller 1, and thus the clamping unit 21', may be required. Stops 16, 17 are fixedly secured to the housing frame 15 in front of and behind the chock 14 of the second 4. Using the stops 16, 17, a directed set-up movement of the roller 1 may be achieved by activating the positioning device 3. If movement of the first roller 1 is required toward the strand center for smaller casting formats, the drive of the positioning device must be moved out. That is, the chock 14 of the second roller 4 is moved toward stop 17. When stop 17 is reached, any further movement of the drive 7 moves the roller 1 toward the strand center. Since first roller 1 is fixed with respect to the clamping unit 21, the clamping unit 21 moves with the first roller 1. To move the first roller 1 in the opposite direction, or away from the existing strand center, another stop 16 is required, and the drive 7 of the positioning device 3 must be moved in. The stops 16, 17 may be selectively placed into their active position, such that, when they are not required, they may be placed in an inactive position which allows the second roller to pass then unimpeded. In this manner a plurality of stops may be placed intermittently along the housing frame and placed into an active position as needed.

This solution allows additional adjustment drives to be dispensed with. An auxiliary drive 18, which must be placed between the clamping unit 21 and the housing frame 15, is needed only when the rollers 1, 4 are moved in and out centrally or if the entire clamping unit 21 is to be removed.

Figure 10:
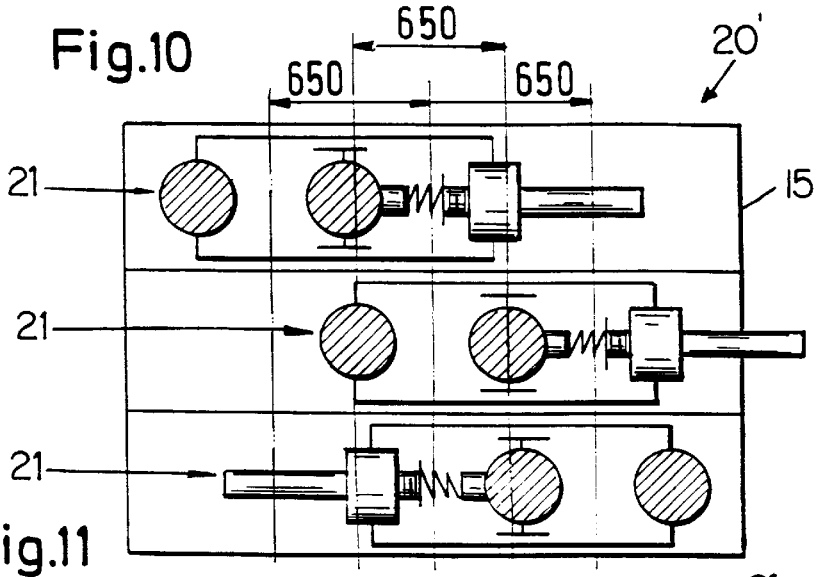

FIG. 10 shows a strand withdrawing device 20 for three strands 13 comprising bolts, in which three short clamping units 21 are arranged in their housing frame 15 one above the other and offset relative to one another. As in FIG. 9, the stand width is 2500 mm.

Figure 11:
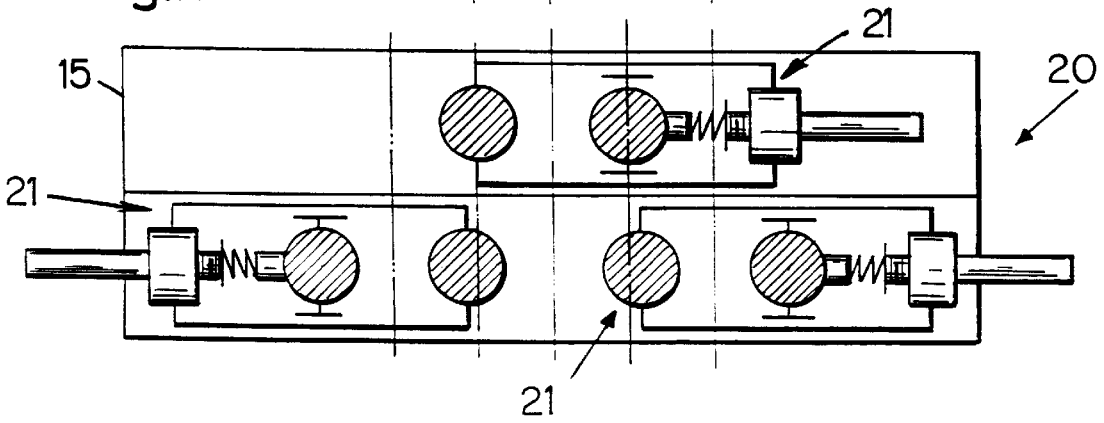

FIG. 11 shows a strand withdrawing device 20 for three strands 13 in a different embodiment. Here, two of the short clamping units 21 are arranged next to each other in a lower portion of the housing frame 15, while a third short clamping unit 21 is arranged above and between the two lower short clamping units 21.

Figure 12:
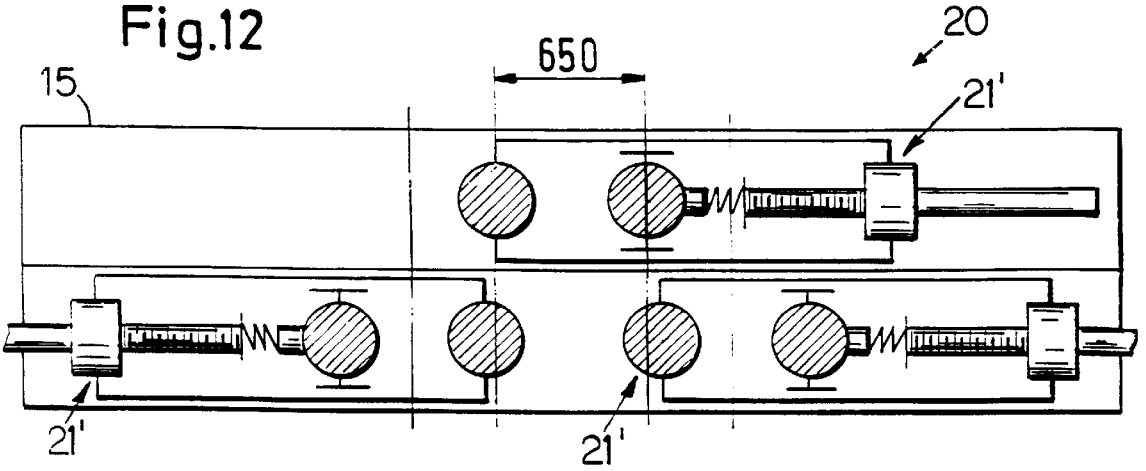

FIG. 12 also shows a strand withdrawing device for three strands as in FIG. 11 using medium clamping units 21'. This embodiment has a stand width of 4500 mm. Accordingly, in this case, larger diameter strands 13 may be withdrawn.

Figure 13:
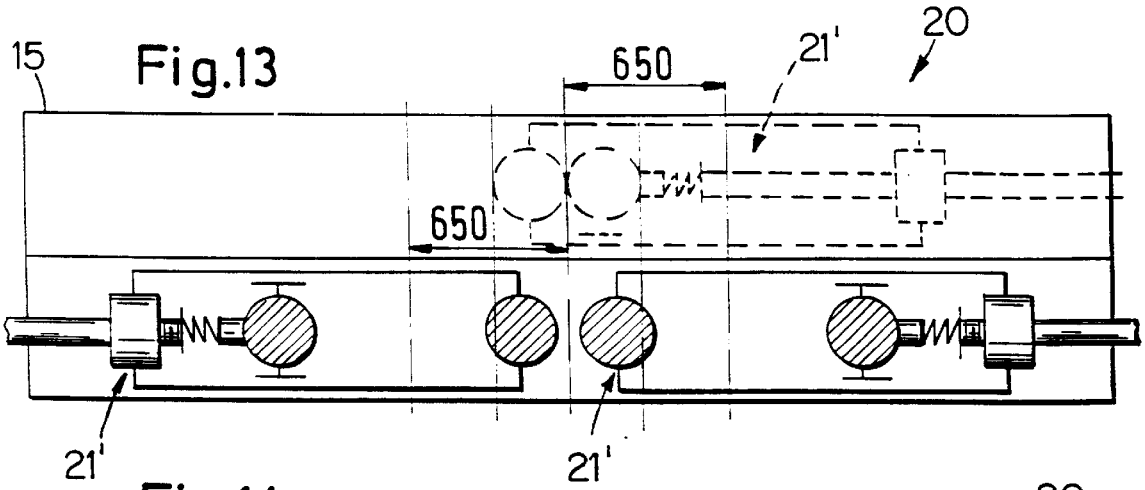

FIG. 13 shows the strand withdrawing device 20 as in FIG. 12 configured for receiving two strands 13 comprising sheet ingots up to 700 mm. The upper medium clamping unit 21' has been moved to the parking position (shown in dashed lines). The upper medium clamping unit 21' may also be removed from the frame 15.

Figure 14:
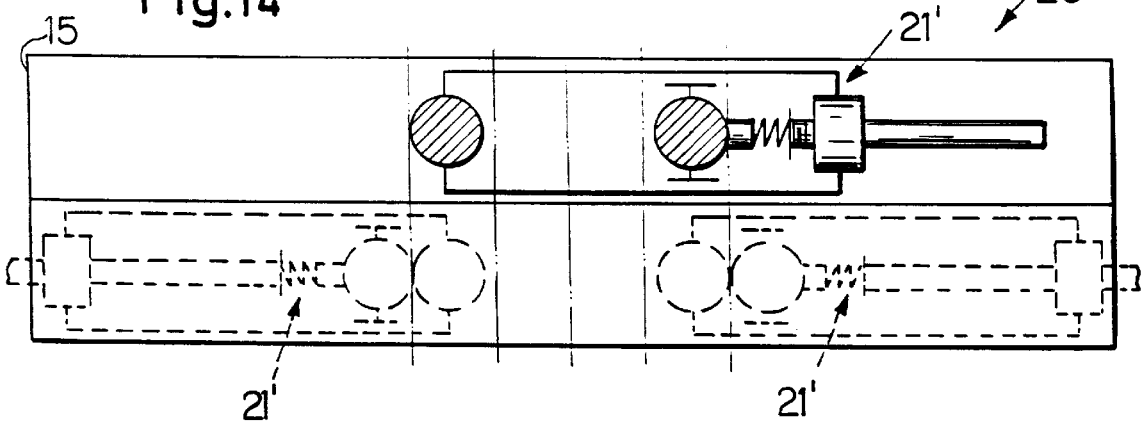

FIG. 14 shows the same strand withdrawing device 20 as in FIG. 13 configured for one strand. The upper medium clamping unit 21' is ready for receiving a strand comprising a sheet ingot up to 700 mm. The lower portion of the housing frame 15 is not occupied. That is, the lower medium clamping units 21' have either been removed or, as shown by the dashed lines, moved into a rest position.

Figure 15:
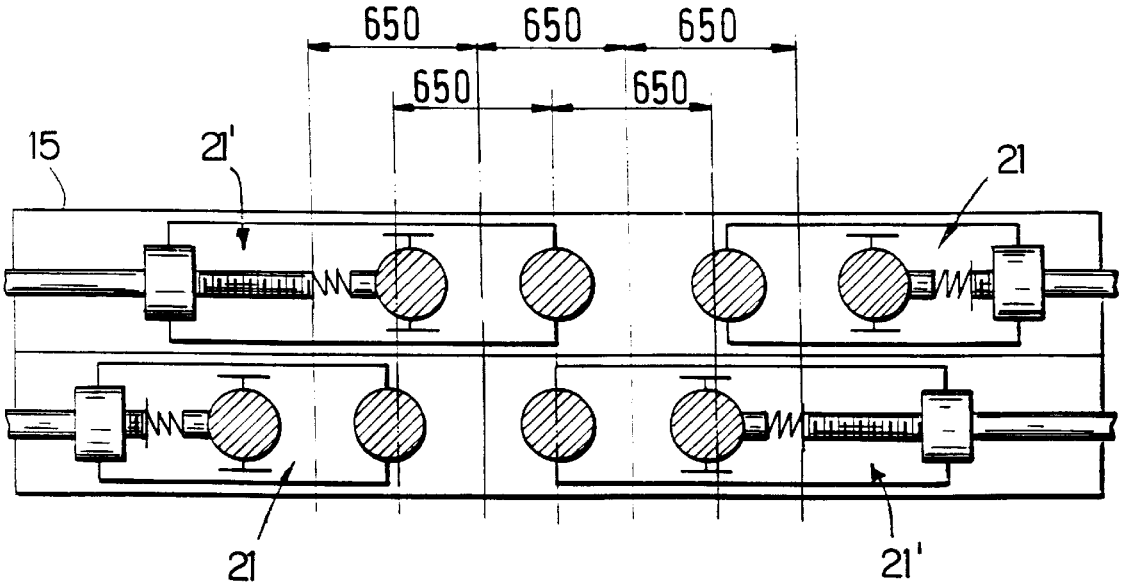

FIG. 15 shows a strand withdrawing device 20 configured for four strands comprising bolts up to 360 mm in diameter. As FIG. 15 shows, the embodiment has a standing width of 4500 mm and thus corresponds to the machine in FIG. 13. Two short clamping units 21 and two medium clamping units 21' are arranged such that four strands can be withdrawn simultaneously, at an equal strand separation distance.

Figure 16:
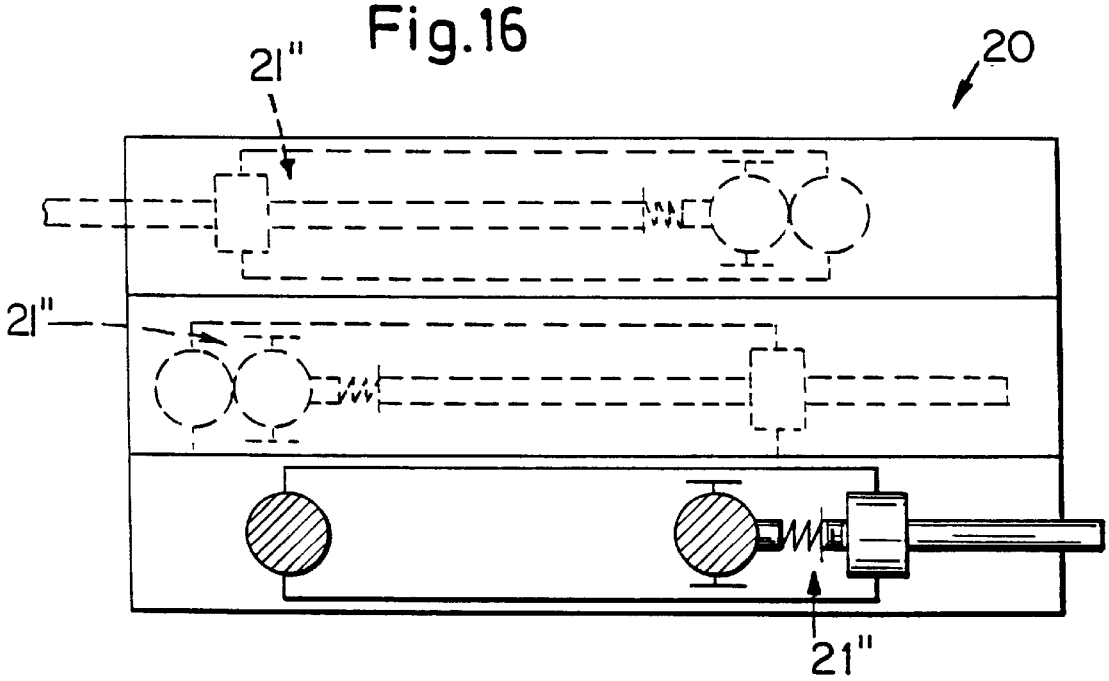

FIG. 16 shows a strand withdrawing device 20 configured for strands comprising sheet ingots up to 1250 mm. Two upper long clamping devices 21" (dashed lines) are either removed from frame 15 or moved into the rest positions, so that only the lower one of the long clamping units 21" is used. Although the bottom long clamping unit 21" is shown, any one of the three could be used alone for this purpose.

Figure 17:
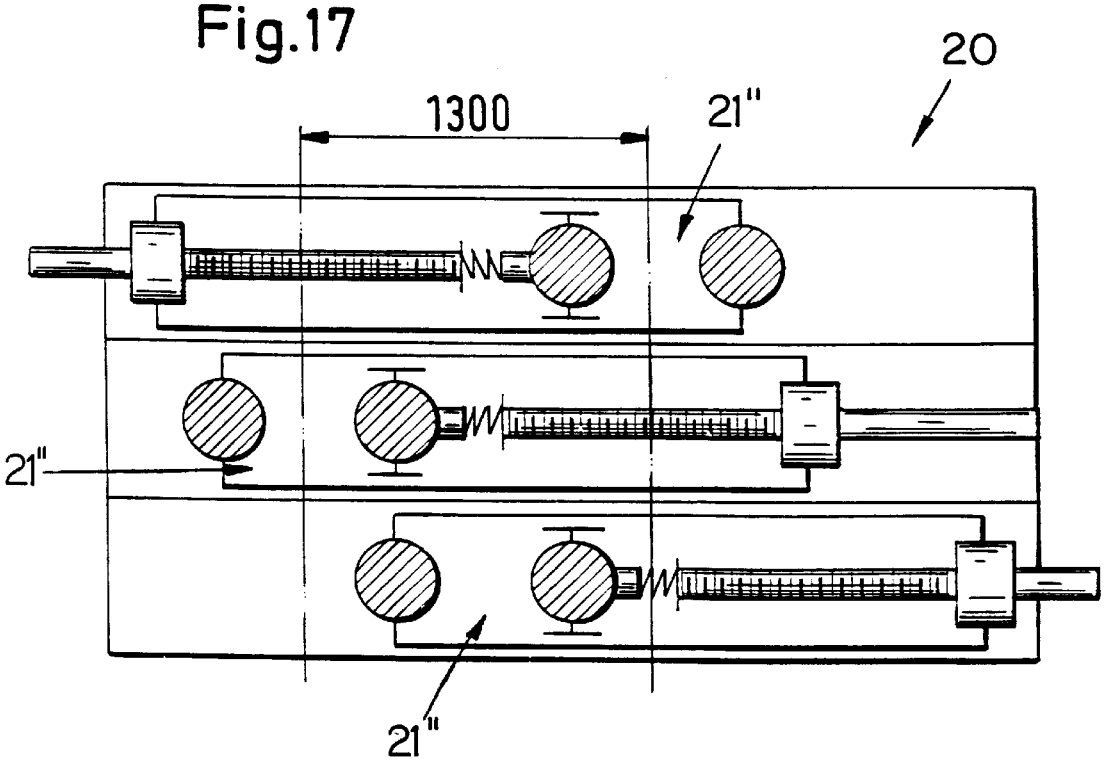

Finally, FIG. 17 shows a three-strand withdrawing device 20 in a frame of 3500 mm width, corresponding to FIG. 16, configured for receiving three strands 13 and using all three long clamping devices 21". It is clear from FIGS. 7–17 that all of the configurations of the strand withdrawing device 20 may be used in very diverse and flexible ways, with only three different embodiments of clamping units 21, 21', and 21", all told, sufficing to cover an extremely large program.

Figure 18:
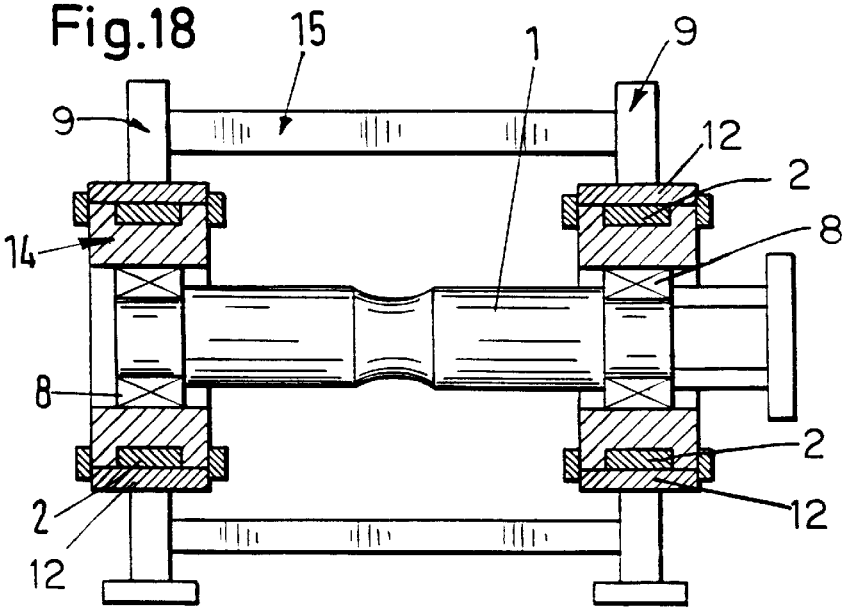
FIG. 18 is a sectional view of the strand withdrawing device through an axis of a first roller showing the bearing of a roller in the chocks.

Referring now to FIG. 18, the position of the bearing 8 of the first roller 1 in the chock 14 is shown. This sectional drawing also shows the arrangement of the tension strips 2 in the housing frame 15 with respect to the guide plate 12.

Figure 19:
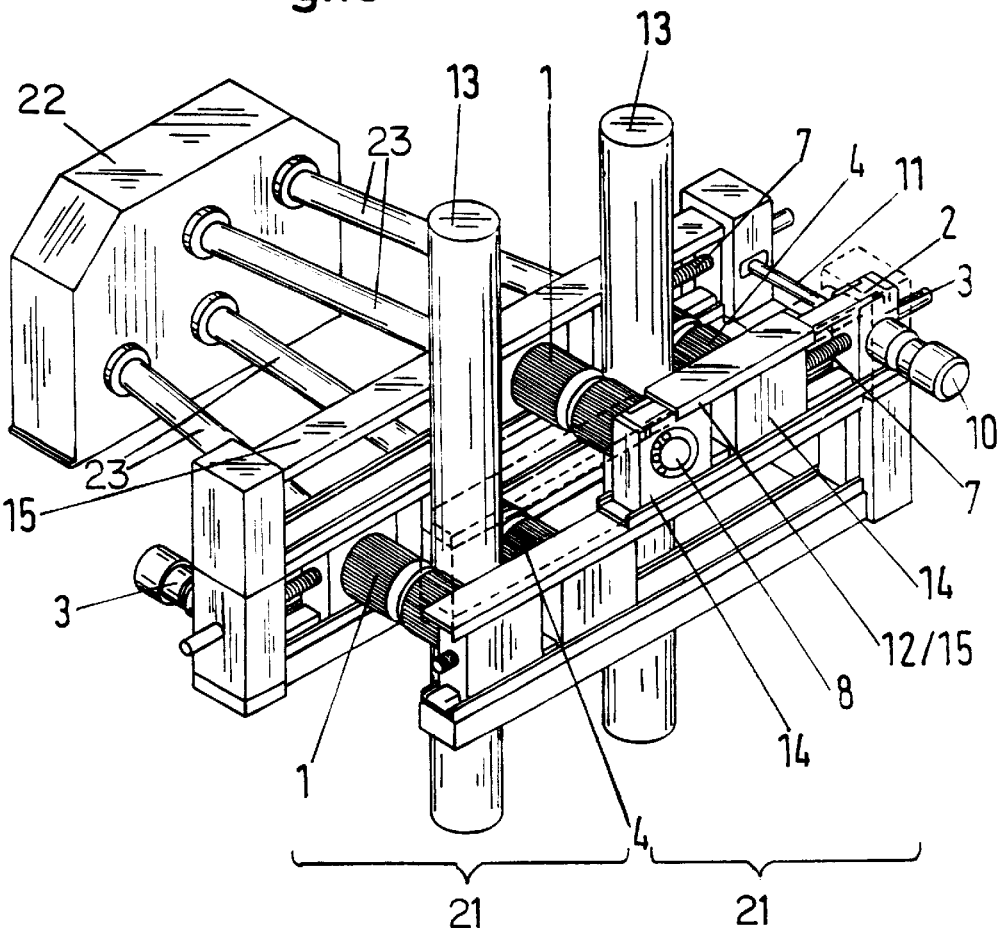
FIG. 19 is a perspective view of a strand withdrawing device for two bolts according to the invention having two clamping units.

FIG. 19 is a perspective view of an embodiment of the strand withdrawing device having two clamping units 21 for withdrawing two strands comprising two bolts. FIG. 19 further shows a stationary distributor gear 22 having articulated drive shafts 23 that are drivably connected to each of the rollers 1, 4 of each clamping unit 21. The articulated drive shafts 23 are remain connected to the rollers 1, 4 even during a repositioning of the rollers 1, 4.

The invention is not limited by the embodiments described above which are presented as examples only but can be modified in various ways within the scope of protection defined by the appended patent claims.

I claim:

1. A device for withdrawing a strand from a continuous casting mold, comprising:

a frame;

a clamping unit having two side pieces mounted parallel to each other in said frame, each of said two side pieces having upper and lower longitudinal members;

first pair of chocks fixedly mounted in said two side pieces;

a second pair of chocks movably mounted in said two side pieces wherein each of said first and second pairs includes a chock mounted in each of said two side pieces;

a first roller rotatably mounted in said first pair of chocks;

a second roller rotatably mounted in a second pair of chocks;

said clamping unit comprising a positioning device fixedly positioned relative to said first pair of chocks via a tension member running through said side pieces and comprising a drive piece movably connected to said positioning device and fixedly connected to each of said second pair of chocks for moving the second roller one of toward and away from the first roller along the two side pieces, said second roller arranged between the positioning device and the first roller; and said first and second rollers arranged on opposing sides of a path of a strand to be withdrawn from a cast mold and wherein said second roller is movable toward and away from the strand surface in a force-operated or pressure-medium operated manner in response to said positioning device.

2. The device for withdrawing a strand of claim 1, wherein said tension member comprise tension strips that fixedly connect the first pair of chocks to the positioning device.

3. The device for withdrawing a strand of claim 1, further comprising a load cell disposed between said drive piece and one of the second pair of chocks.

4. The device for withdrawing a strand of claim 1, further comprising disc springs disposed between said drive piece and said second pair of chocks.

5. The device for withdrawing a strand of claim 1, wherein said positioning device comprises an independent drive unit for each of said second pair of chocks.

6. The device for withdrawing a strand of claim 1, wherein said positioning device for each of said second pair of chocks are connected by a connecting shaft and are drivable by a common drive motor.

7. The device for withdrawing a strand of claim, wherein said first pair of chocks and said second pair of chocks comprise spherical roller bearings in which ends of said first roller and second roller are received for mounting.

8. The device for withdrawing a strand of claim 1, wherein one of the first roller and the second roller is set to a strand format for set-up operation in the frame.

9. The device for withdrawing a strand of claim 1, wherein said clamping unit comprises an exchangeable module mountable in said frame.

10. The device for withdrawing a strand of claim 9, further comprising a plurality of clamping units placed one of atop each other and along side each other in said frame.

11. The device for withdrawing a strand of claim 10, wherein said plurality of clamping units comprise at least a first and second type of clamping units having two different longitudinal dimensions.

12. The device for withdrawing a strand of claim 1, wherein said frame is a modular frame comprising supports, carriers and traverses that are fixedly connectable to each other.

13. The device for withdrawing a strand of claim 1, comprising stops secured to said frame in front of and behind said second pair of chocks thereby limiting an mount of movement of said second pair of chocks within said frame.

14. The device for withdrawing a strand of claim 1, comprising an auxiliary drive operatively connected between said clamping unit and said frame for centrally moving said clamping unit into and out of said frame.

* * * * *